US007052248B2

(12) United States Patent
Yagi et al.

(10) Patent No.: US 7,052,248 B2
(45) Date of Patent: May 30, 2006

(54) CLOSED COMPRESSOR

(75) Inventors: Akio Yagi, Singapore (SG); Ikutomo Umeoka, Kanagawa (JP); Tsuyoshi Matsumoto, Kanagawa (JP); Yasushi Hayashi, Singapore (SG); Tomio Maruyama, Kanagawa (JP)

(73) Assignee: Matsushita Refrigeration Company, Shiga (JP)

( * ) Notice: Subject to any disclaimer, the term of this patent is extended or adjusted under 35 U.S.C. 154(b) by 131 days.

(21) Appl. No.: 10/489,364

(22) PCT Filed: Dec. 3, 2002

(86) PCT No.: PCT/JP02/12637

§ 371 (c)(1),
(2), (4) Date: Mar. 12, 2004

(87) PCT Pub. No.: WO03/048574

PCT Pub. Date: Jun. 12, 2003

(65) Prior Publication Data

US 2004/0241011 A1 Dec. 2, 2004

(30) Foreign Application Priority Data

Dec. 5, 2001 (JP) ..... 2001-371248

(51) Int. Cl.
*F04B 39/00* (2006.01)

(52) U.S. Cl. ..... 417/312; 181/229; 181/249; 181/403

(58) Field of Classification Search ..... 417/312; 181/229, 249, 250, 403
See application file for complete search history.

(56) References Cited

U.S. PATENT DOCUMENTS

| | | | | |
|---|---|---|---|---|
| 5,228,843 | A | 7/1993 | Novolan et al. | |
| 5,496,156 | A * | 3/1996 | Harper et al. | 417/312 |
| 5,734,134 | A | 3/1998 | Park | |
| 6,186,751 | B1 | 2/2001 | Rigo | |
| 6,206,655 | B1 | 3/2001 | Tanaka et al. | |
| 6,415,888 | B1 * | 7/2002 | An et al. | 181/229 |
| 6,547,032 | B1 * | 4/2003 | Yoon et al. | 181/229 |
| 6,547,535 | B1 * | 4/2003 | Kueon | 417/312 |
| 6,692,238 | B1 * | 2/2004 | Myung et al. | 417/312 |

FOREIGN PATENT DOCUMENTS

| | | | |
|---|---|---|---|
| EP | 0 897 060 | | 2/1999 |
| EP | 0 984 162 | | 3/2000 |
| JP | 2000-130147 | * | 5/2000 |

* cited by examiner

*Primary Examiner*—Michael Koczo, Jr.
(74) *Attorney, Agent, or Firm*—Wenderoth, Lind & Ponack, L.L.P.

(57) ABSTRACT

A hermetic compressor is equipped with a suction muffler including: a muffling space having two rooms; a communication space to communicate these two rooms with each other; a first communication passage to communicate a movable valve with the muffling space and extending to an opening into the muffling space; and a second communication passage to communicate an enclosed container with the muffling space and extending to an opening into the muffling space. The openings into the muffling space from the first and the second communication passages are disposed in one of the two rooms, and the other room of the two rooms forms a resonance muffler whose resonance frequency matches a cavity resonance frequency of the enclosed container. The configuration can provide the hermetic compressor with a reduced noise emission and a high compression efficiency.

16 Claims, 5 Drawing Sheets

FIG. 5 – PRIOR ART
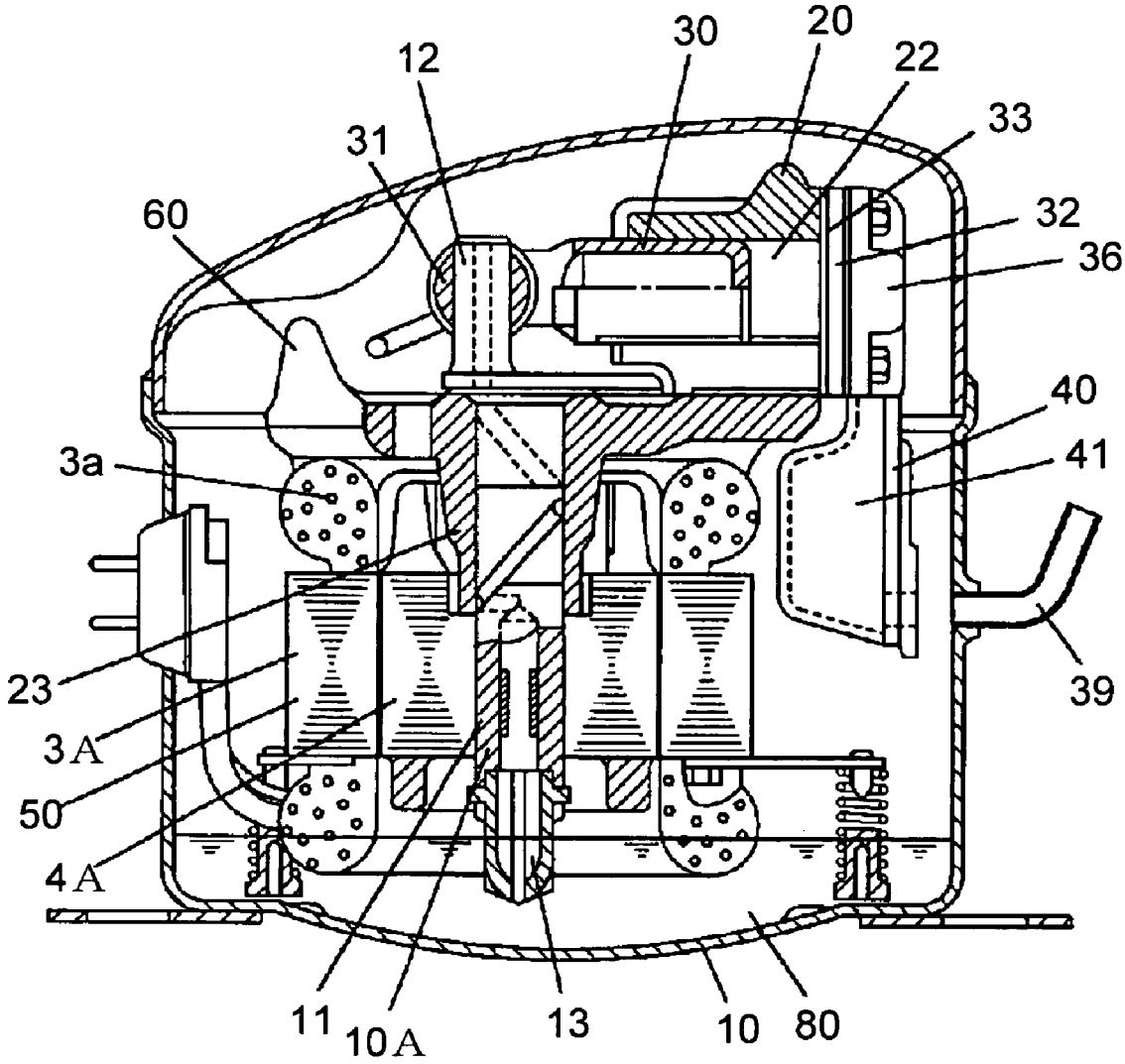

FIG. 6 – PRIOR ART
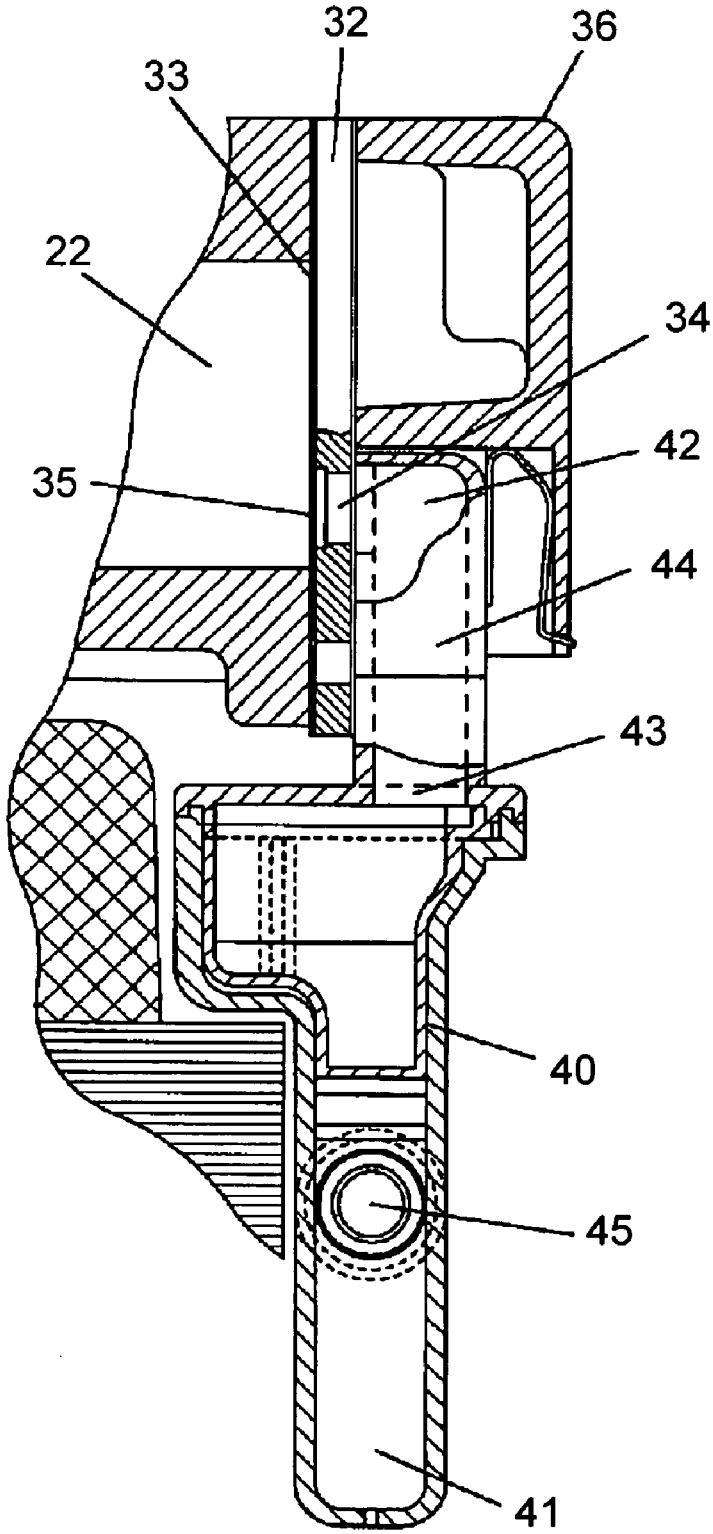

CLOSED COMPRESSOR

TECHNICAL FIELD

The present invention relates to a hermetic compressor for use in refrigerator, air-conditioner and refrigerating plant or the like.

BACKGROUND ART

Recently, highly efficient and down-sized hermetic compressors with reduced noise emission have been required for refrigerating plants and the like.

U.S. Pat. No. 5,228,843 or Japanese Patent Laid-Open Application No. 2001-503833 discloses conventional hermetic compressors.

Now, a conventional hermetic compressor is described with reference to the drawings. FIG. 5 shows a longitudinal sectional view of the conventional hermetic compressor. FIG. 6 shows a partial sectional view of the conventional hermetic compressor. In FIGS. 5 and 6, enclosed container 10 encloses motor element 50 consisting of stator 3A with winding 3*a* and rotor 4A, and compressor element 60 driven by motor element 50. Oil 80 is stored in the enclosed container 10. Crankshaft 10A has main axial section 11 pressed to insert securely in rotor 4A and eccentric section 12 disposed in an eccentric position with respect to main axial section 11. Oil pump 13 provided internally of main axial section 11 of the crankshaft has an opening in oil 80. Cylinder block 20 having an approximately cylindrical shaped compression chamber 22 and bearing element 23 to hold main axial section 11 is disposed above motor element 50. Piston 30 is reciprocably inserted into compression chamber 22 and is coupled to eccentric section 12 via coupler 31. Suction valve 35 comprises valve plate 32 to close an end face of compression chamber 22, movable valve 33 and suction hole 34 drilled in the valve plate to communicate with compression chamber 22. Head 36 forming a high-pressure chamber is fixed opposite to valve plate 32 of compression chamber 22. Suction pipe 39 fixed to enclosed container 10 is coupled to a low-pressure side (not shown) of the refrigerating cycle to draw the refrigerant gas (not shown) into enclosed container 10. Suction muffler 40 is fixedly held between muffling space 41, valve plate 32 and head 36. First end 42 of communication passage 44 is communicated with suction hole 34 of valve plate 32. Second end 43 of communication passage 44 opens into muffling space 41, and opening 45 communicating with an interior of muffling space 41 and an interior of enclosed container 10 to open adjacent to suction pipe 39.

An operation of the hermetic compressor with the aforementioned configuration is described. Rotor 4A of motor element 50 rotates crankshaft 10A, and the rotation movement of eccentric section 12 travels to piston 30 via coupler 31. As piston 30 reciprocates in compression chamber 22, refrigerant gas flows into enclosed container 10 from the refrigerating system (not shown) through suction pipe 39. The flowed in refrigerant gas is sucked into muffling space 41 through opening 45 of suction muffler 40.

Next, the refrigerant gas flowing intermittently into compression chamber 22 via suction valve 35 through passage 44 and suction inlet opening 34 is compressed and then discharged to the refrigerating system. Here, at the time when the refrigerant gas is sucked into compression chamber 22, opening/shutting movements of movable valve 33 generate pressure pulsations in the refrigerant gas and the pressure pulsations propagate in a direction opposite to the stream of the above refrigerant gas. The pressure pulsations of the refrigerant gas attenuate and muffle in repeated expansion and contraction during the flow of refrigerant gas through communication passage 44, muffling space 41 and opening 45 in suction muffler 40 having respective different cross sectional areas.

In the aforementioned conventional configuration, however, pressure pulsations generated in the refrigerant gas by opening/shutting movements of movable valve 33 do not attenuate sufficiently. In addition, the pressure waves have large values at the passage opening 43 disposed at the end of muffling space 41. In muffling space 41, sound propagating compressional waves form standing waves for some natural frequencies by reflection. The sound pressure is high in dense portions (hereafter referred to as anti-node) of the standing waves and low in non-dense portions (hereafter referred to as node) of the standing waves. Among a distribution of the standing waves, the node is not produced at the end of muffling space 41. The problem is, therefore, that the noises do not attenuate sufficiently for some natural frequencies in the conventional art. Additionally, in the aforementioned conventional art, the refrigerant gas sucked through opening 45 is discharged to muffling space 41 having a large space capacity before being sent to communication passage 44. Here, the refrigerant gas receives heat energy from inner surfaces of muffling space 41 resulting in reduction of refrigerant gas density to cause a reduced refrigerating capacity.

Moreover, the resonance frequency of communication passage 44 that is determined by the length of communication passage 44 is difficult to adjust in the conventional art because communication passage 44 can not be extended any more. Consequently, pressure pulsations in communication passage 44 varied by the resonance frequency can not be maximized at the time just before the opening time of movable valve 33. The problem is that the volume of refrigerant gas flowing into compression chamber 22 decreases to cause a poor refrigerating capacity and efficiency.

The present invention aims to provide a hermetic compressor with a reduced noise emission in the muffling space of the suction muffler and an improved refrigerating capacity and efficiency to solve the aforementioned problems.

DISCLOSURE OF THE INVENTION

The present invention aims to provide a hermetic compressor comprising: a compression element; a motor element to drive rotatably the compression element; and an enclosed container that encloses the compression element and the motor element, and stores lubrication oil.

The compression element includes: a cylinder block with a compression chamber; a valve plate forming a suction valve together with a movable valve to close an opening of the compression chamber of the cylinder block; a head forming a high-pressure chamber fixed to the cylinder block via the valve plate; and a suction muffler having a muffling space.

The suction muffler includes: two rooms and a communication space communicationg the two rooms; a first communication passage communicating the movable valve with the muffling space and extending into the muffling space to form an opening in the muffling space; and a second communication passage form communicating the enclosed container with the muffling space and extending into the muffling space to form an opening in the muffling space, wherein the openings in the muffling space from the first and the second communication passages are disposed in one of the two rooms, and the other room of the two rooms together with the communication space form a resonance muffler whose resonance frequency matches with a cavity resonance frequency of the enclosed container.

BRIEF DESCRIPTION OF THE DRAWINGS

FIG. 5 shows a longitudinal sectional view of a conventional compressor.

FIG. 6 shows a cross-sectional view of a suction muffler used in a conventional compressor.

EXEMPLARY EMBODIMENT OF THE INVENTION

Now, an exemplary embodiment of the hermetic compressor disclosed in the present invention is described with reference to the drawings. The drawings are shown in schematic views and are not dimensioned correctly with regard to respective positioning.

Figure 1:
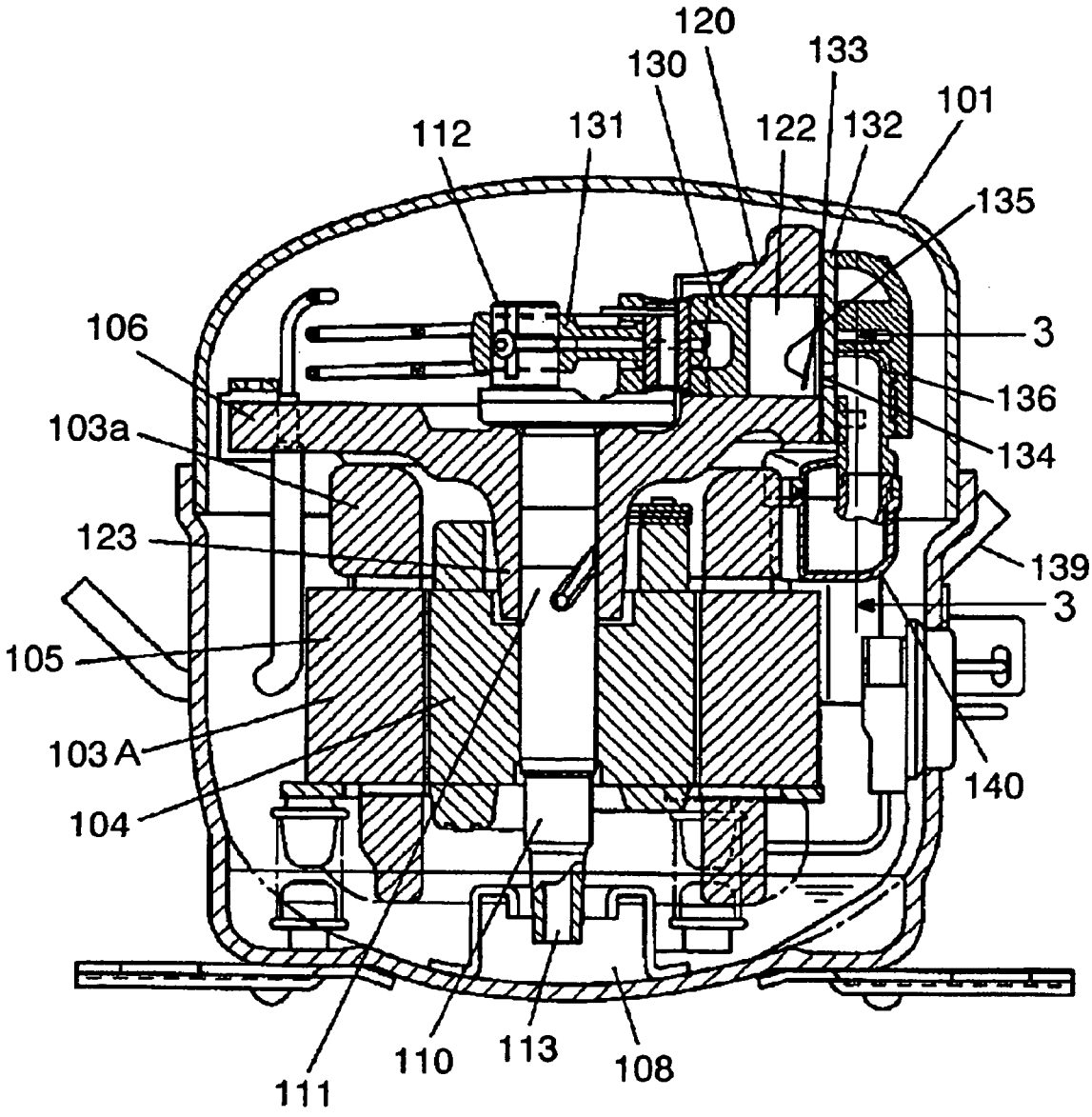
FIG. 1 shows a longitudinal sectional view of a hermetic compressor used in the exemplary embodiment of the present invention.
Figure 2:
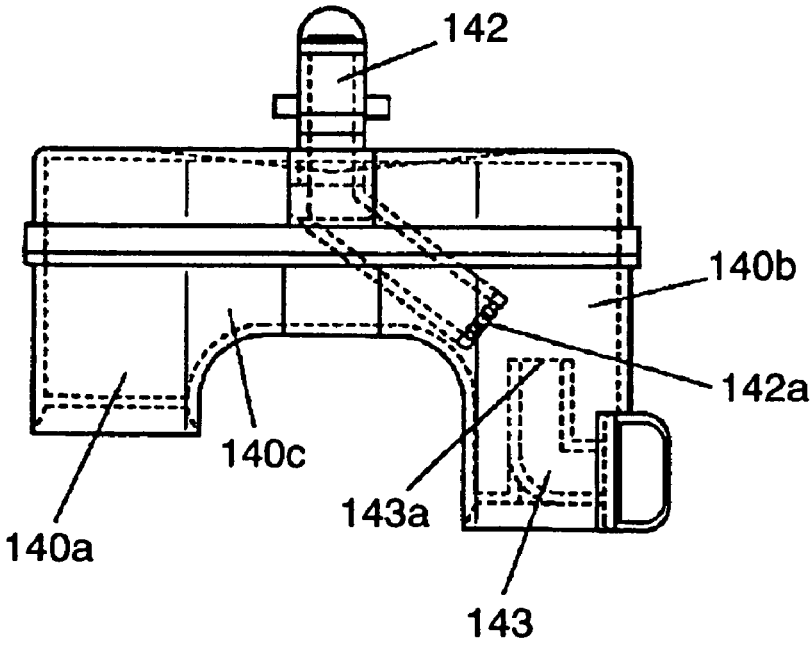
FIG. 2 shows a front view of a suction muffler used in the exemplary embodiment of the present invention.
Figure 3:
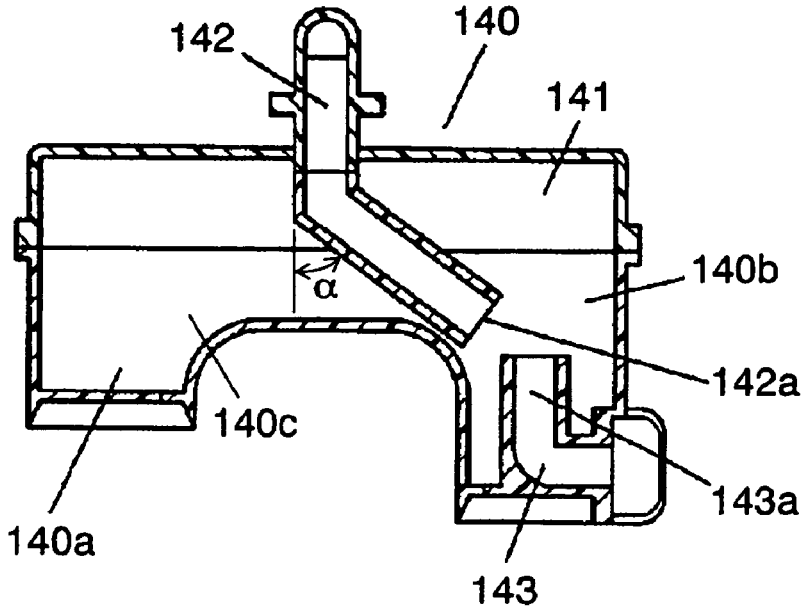
FIG. 3 shows a front sectional view taken along the line 3—3 of FIG. 1.

Enclosed container 101 contains motor element 105 constituted by stator 103A with winding 103*a* and rotor 104, and compressor element 106 driven by motor element 105 as shown in FIGS. 1 to 3. Oil 108 is stored in enclosed container 101. Crankshaft 110 has main axial section 111 pressed to insert securely against rotor 104 and eccentric section 112 disposed in an eccentric position with respect to main axial section 111. Oil pump 113 provided inside of main axial section 111 of the crankshaft has an opening in oil 108. Cylinder block 120 having a substantially cylindrical shaped compression chamber 122 and bearing portion 123 to hold main axial section 111 is disposed above motor element 105. Piston 130 is reciprocably inserted into compression chamber 122 and is coupled to eccentric portion 112 via coupler 131. Suction valve 135 comprises valve plate 132 to close an end face of compression chamber 122, resilient plate 132 shaped movable valve 133 and suction hole 134 drilled in the valve plate to communicate with compression chamber 122. Head 136 forming a high-pressure chamber is fixed to cylinder block 120 via valve plate 132. Suction pipe 139 fixed to enclosed container 101 is coupled to a low-pressure side (not shown) of the refrigerating system to draw the refrigerant gas R134*a* (not shown) into enclosed container 101. Here, enclosed container formed of iron plate by press working has a primary natural frequency of approximately 2.5 kHz. In addition, the cavity resonance frequency in enclosed container 101 is approx. 500 Hz with the use of refrigerant gas R134*a*. Movable valve 133 has a primary natural frequency of approx. 250 Hz and a secondary natural frequency of approx. 500 Hz. Suction muffler 140 has muffling space 141 internally. Muffling space 141 is formed of two rooms (i.e., room A 140*a* and room B 140*b*) and communication space 140*c* to communicate with these rooms. Room A 140*a* and room B 140*b* are parted right and left with head 136 being centered. First communication passage 142 communicates movable valve 133 with muffling space 141. Additionally, first communication passage 142 extends into muffling space 141 being inflected with an angle indicated by $\alpha$ of approximately 50 degree to dispose first opening 142*a* open to room B 140*b* in muffling space 141. Second communication passage 143 communicates the interior of the enclosed container 101 with muffling space 141. Second opening 143*a* opens into room B 140*b* in muffling space 141. The first opening and the second opening are located to open adjacently in room B 140*b*. Room A 140*a* together with communication space 140*c* forms a resonance muffler having a natural frequency of approx. 500 Hz.

The resonance frequency is adjusted to approx. 750 Hz using the length of first communication passage 142 of approx. 70 mm. The frequency corresponds to triple that of the primary natural frequency of movable valve 133 of 250 Hz.

On the other hand, the frequency does not correspond to any one of the frequency group including; the cavity resonance frequency in enclosed container 101 of approx. 500 Hz; the primary natural frequency of movable valve 133 of approx. 250 Hz; the secondary natural frequency of the movable valve 133 of approx. 500 Hz; and the natural frequency of enclosed container 101 of approx. 2.5 kHz.

The resonance frequency is adjusted to approx. 1.2 kHz using the length of second communication passage 143 of 60 mm. The frequency does not correspond to any one of the frequency group including; the cavity resonance frequency of enclosed container 101 of approx. 500 Hz; the primary natural frequency of movable valve 133 of approx. 250 Hz; the secondary natural frequency of the movable valve 133 of approx. 500 Hz; and the natural frequency of enclosed container 101 of approx. 2.5 kHz.

Moreover, both of first opening 142*a* of first communication passage 142 and second opening 143*a* of second communication passage 143 are located in room B 140*b* of muffling space 141. The locations of the openings are allowed to correspond to a node of natural frequency of 2.5 kHz of enclosed container 101.

Next, an operation of the hermetic compressor with the aforementioned configuration is described. Rotor 104 of motor element 105 rotates crankshaft 110 accompanying the rotary movement of eccentric section 112 that is conducted to piston 130 via coupler 131. As piston 130 reciprocates in compression chamber 122, refrigerant gas R134*a* flows into enclosed container 101 from the refrigerating system (not shown). The refrigerant gas first flows into enclosed container 101 through suction pipe 139. Then, the refrigerant gas is released to room B 140*b* via second communication passage 143 of suction muffler 140. Next, traveling through suction hole 134 via first communication passage 142, the refrigerant gas flows into compression chamber 122, when movable valve 133 is opened, and is compressed then discharged to the refrigerating system. Movable valve 133 opens and shuts when refrigerant gas R134*a* is sucked into compression chamber 122.

The opening/shutting movement of movable valve 133 generates pressure pulsations of various frequencies. The pressure pulsations propagate in a direction opposite to the stream of the aforementioned refrigerant gas. Among the pressure pulsations, 500 Hz wave that is a natural frequency of cavity resonance acts as an oscillation source when the wave reaches into enclosed container 101.

Consequently, 500 Hz band noises, corresponding to the natural frequency of cavity resonance of enclosed container 101, increase in enclosed container 101. However, 500 Hz band noises in the pressure pulsations attenuate greatly in room B 140*b* because a resonance muffler having the resonance frequency of approx. 500 Hz is produced by room A 140*a* together with communication space 140*c*. Additionally, both of the resonance frequency of first communication passage 142 of approx. 750 Hz and the resonance frequency of second communication passage 143 of approx. 1.2 kHz do not meet the frequency of 500 Hz. Attenuating also in both first communication passage 142 and second communication passage 143, the 500 Hz band noises generated by the pressure pulsations are further hard to propagate into enclosed container 101. As mentioned above, the oscillating power caused by the cavity resonance in enclosed container 101 is reduced with the use of refrigerant gas R134*a*. Consequently, 500 Hz band noises caused by the cavity resonance in enclosed container 101 can be suppressed to a low level.

Additionally, among pulsation components generated by opening/shutting movements of movable valve 133, 2.5 kHz band noises induce a resonance with a natural frequency of enclosed container 101 when released into the space of enclosed container 101. Then, the sound phenomenon occurs in enclosed container 101. On the other hand, both of first opening 142*a* of first communication passage 142 and second opening 143*a* of second communication passage 143 open at positions corresponding to the nodes of vibration mode of 2.5 kHz band noises in muffling space 141. Consequently, 2.5 kHz band noises generated by opening/shutting movements of movable valve 133 attenuate greatly in the muffling space. In addition to this, both of approx. 750 Hz resonance frequency of first communication passage 142 and approx. 1.2 kHz resonance frequency of second communication passage 143 do not meet the frequency of 2.5 kHz. Namely, 2.5 kHz band noises caused by pressure pulsation attenuate also in both of first communication passage 142 and second communication passage 143. The 2.5 kHz band noises are thus further suppressed to propagate into enclosed container 101. The configuration can prevent 2.5 kHz band noises from propagating from suction muffler 140 into enclosed container 101. Noises caused by resonance of 2.5 kHz band in enclosed container can be thus prevented.

Additionally, first communication passage 142 has the resonance frequency of approx. 750 Hz and second communication passage 143 has the resonance frequency of approx. 1.2 kHz respectively. Both of these frequencies do not meet any one of the primary natural frequency of movable valve 133 of approx. 250 Hz and the secondary natural frequency of approx. 500 Hz. Therefore, though having a large energy close to fundamental wave energy, the pressure pulsations generated by opening/shutting movements of movable valve 133 to suck refrigerant gas R134*a* into compression chamber 122 attenuate in first communication passage 142 and second communication passage 143 resulting in the pressure pulsations being suppressed at a low level when released in enclosed container 101.

On the other hand, upon operation of the compressor, movable valve 133 opens and shuts suction hole 134 in response to the reciprocating movements of piston 130. In this regard, movable valve 133 performs plural opening/shutting movements per one reciprocating motion of piston 130 according to its own natural frequency. At the instant when movable valve 133 opens to suck the refrigerant gas into compression chamber 122, negative pressure waves are generated in the vicinity of suction hole 134. The negative pressure waves propagate through first communication passage 142 and reflect at first opening 142*a* to return back soon in the vicinity of suction hole 134 after being converted to positive pressure waves. Consequently, the pressure adjacent to movable valve 133 increases contrarily.

Therefore, an integral multiple of the natural frequency of movable valve 133 is adopted for the resonance frequency ratio determined by the length and diameter of first communication passage 142. Then, opening/shutting timing of movable valve 133 is tuned in the pressure wave in first communication passage 142. Consequently, the pressure adjacent to movable valve 133 can be increased while movable valve 133 opens. Namely, a supercharging effect can be expected.

Figure 4:
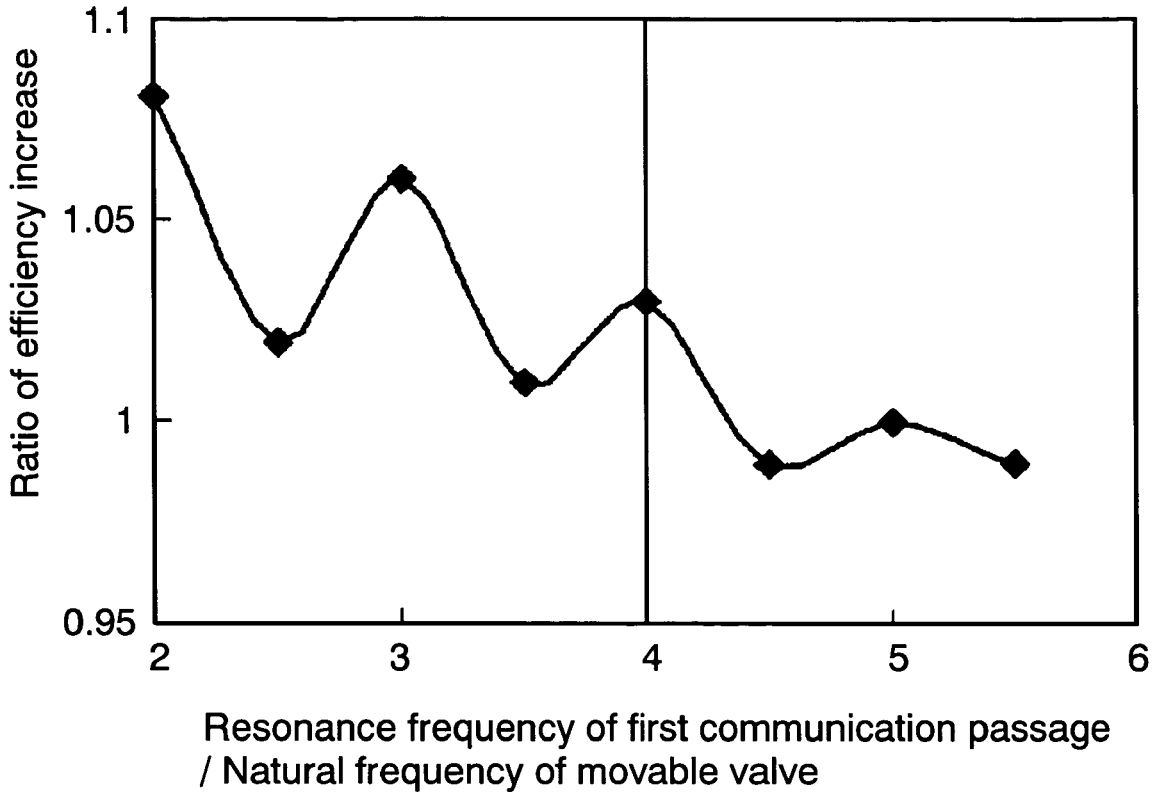
FIG. 4 a graph showing a relation between the resonance frequency of a first communication passage and the efficiency of the hermetic compressor used in the exemplary embodiment of the present invention.

FIG. 4 shows a relation between the resonance frequency of first communication passage 142 and the efficiency increase due to the super-charging effect in a hermetic compressor used in the exemplary embodiment. A significant efficiency increase is observed when the ratio for the resonance frequency of first communication passage 142 to the natural frequency of movable valve 133 is an integral multiple of not larger than 4 as shown in the drawing. In the exemplary embodiment, the resonance frequency of first communication passage 142 is set as a triple number of 750 Hz against 250 Hz, the natural frequency of movable valve 133.

Consequently, efficiency of the hermetic compressor increases because refrigerant gas volume sucked into compression chamber 122 increases to improve the suction efficiency due to the aforementioned supercharging effect. In addition, first communication passage 142 is inflected with an angle of approx. 50 degrees. The structure can reduce the flow resistance of refrigerant gas. The angle is preferably not smaller than 0 deg. and not larger than 60 deg., and the flow resistance runs up rapidly if the angle exceeds 75 degrees.

Moreover, first opening 142*a* of first communication passage 142 and second opening 143*a* of second communication passage 143 open adjacent each other in room B 140*b*. The structure allows refrigerant gas R134*a* to be sucked into room B 140*b* of suction muffler 140 from second communication passage 143 to be drawn into compression chamber 122 through first communication passage 142 via suction valve 134 with little heat received. Dense refrigerant gas, therefore, can be drawn into compression chamber 122 to provide a highly efficient compression performance.

Needless to say, other refrigerant gas than R134*a* adopted in the description can perform the same purpose of this invention.

INDUSTRIAL APPLICABILITY

The present invention provides a hermetic compressor that can reduce noise emission caused by cavity resonance in the enclosed container and to have a highly efficient compression performance due to reduced heat influence on refrigerant gas.

The invention claimed is:

1. A hermetic compressor comprising: (a) a compression element; (b) a motor element to drive rotatably said compression element; and (c) an enclosed container that encloses said compression element and said motor element, and stores lubrication oil, wherein said compression element includes: (d) a cylinder block including a compression chamber; (e) a valve plate forming a suction valve together with a movable valve to close an opening of said compression chamber of said cylinder block; (f) a head forming a high-pressure chamber, said head being fixed to said cylinder block via said valve plate; and (g) a suction muffler including a muffling space, wherein said suction muffler includes: (h) said muffling space formed of two rooms and a communication space communicating said two rooms; (i) a first communication passage communicating said movable valve with said muffling space and extending into said muffling space to form an opening in said muffling space; and (j) a second communication passage communicating said enclosed container with said muffling space and extending into said muffling space to form an opening to said muffling space, wherein said openings in said muffling space from said first and said second communication passages are disposed in one of said two rooms, and the other room of said two rooms together with said communication space form a resonance muffler having a resonance frequency matching with a cavity resonance frequency of said enclosed container.

2. The hermetic compressor according to claim 1, wherein one of said openings in said muffling space is provided at a position corresponding to a node of a natural frequency of said muffling space.

3. The hermetic compressor according to claim 1, wherein said first communication passage has a resonance frequency of an integral multiple of not larger than 4 of a natural frequency of said movable valve.

4. The hermetic compressor according to claim 1, wherein at least a portion of said first communication passage extended into said muffling space is inflected with an angle of not larger than 60 degrees with respect to another portion of said first communication passage disposed outside said muffling space.

5. The hermetic compressor according to claim 1, wherein said first communication passage and said second communication passage respectively have a resonance frequencies different from a cavity resonance frequency in said enclosed container.

6. The hermetic compressor according to claim 1, wherein said first communication passage and said second communication passage respectively have a resonance frequencies different from a primary and a secondary resonance frequency of said movable valve.

7. The hermetic compressor according to claim 1, wherein said first communication passage and said second communication passage respectively have resonance frequencies different from a natural frequency of said enclosed container.

8. The hermetic compressor according to claim 2, wherein said first communication passage has a resonance frequency of an integral multiple of not larger than 4 of a natural frequency of said movable valve.

9. The hermetic compressor according to claim 2, wherein at least a portion of said first communication passage extended into said muffling space is inflected with an angle of not larger than 60 degrees with respect to another portion of said first communication passage disposed outside said muffling space.

10. The hermetic compressor according to claim 3, wherein at least a portion of said first communication passage extended into said muffling space is inflected with an angle of not larger than 60 degrees with respect to another portion of said first communication passage disposed outside said muffling space.

11. The hermetic compressor according to claim 2, wherein said first communication passage and said second communication passage respectively have resonance frequencies different from a cavity resonance frequency in said enclosed container.

12. The hermetic compressor according to claim 3, wherein said first communication passage and said second communication passage respectively have resonance frequencies different from a cavity resonance frequency in said enclosed container.

13. The hermetic compressor according to claim 2, wherein said first communication passage and said second communication passage respectively have a resonance frequencies different from both a primary and a secondary resonance frequency of said movable valve.

14. The hermetic compressor according to claim 2, wherein said first communication passage and said second communication passage respectively have resonance frequencies different from both a primary and a secondary resonance frequency of said movable valve.

15. The hermetic compressor according to claim 2, wherein said first communication passage and said second communication passage respectively have a resonance frequencies different from a natural frequency of said enclosed container.

16. The hermetic compressor according to claim 3, wherein said first communication passage and said second communication passage respectively have resonance frequencies different from a natural frequency of said enclosed container.

* * * * *

UNITED STATES PATENT AND TRADEMARK OFFICE

CERTIFICATE OF CORRECTION

PATENT NO. : 7,052,248 B2
APPLICATION NO. : 10/489364
DATED : May 30, 2006
INVENTOR(S) : Akio Yagi et al.

It is certified that error appears in the above-identified patent and that said Letters Patent is hereby corrected as shown below:

IN THE CLAIMS

Claim 5,
In column 7, line 37, please replace “have a resonance” with --have resonance--.

Claim 6,
In column 7, line 42, please replace “have a resonance” with --have resonance--.

Claim 13,
In column 8, line 29, please replace “have a resonance” with --have resonance--.

Claim 15,
In column 8, line 39, please replace “have a resonance” with --have resonance--.

Signed and Sealed this

Twenty-sixth Day of December, 2006

JON W. DUDAS
*Director of the United States Patent and Trademark Office*